United States Patent [19]

Zollinger

[11] Patent Number: 4,605,182

[45] Date of Patent: Aug. 12, 1986

[54] YARN TENSION CONTROL DEVICE

[75] Inventor: Otto Zollinger, Spartanburg, S.C.

[73] Assignee: Otto Zollinger, Inc., Spartanburg, S.C.

[21] Appl. No.: 778,303

[22] Filed: Sep. 20, 1985

[51] Int. Cl.[4] ..... B65H 59/22

[52] U.S. Cl. ..... 242/149; 57/18; 57/58.36

[58] Field of Search ..... 242/149, 150 R, 150 M, 242/147 R, 147 A, 147 M, 151, 152, 152.1, 153, 154, 75.2; 226/195; 57/17, 18, 58.36, 58.38

[56] References Cited

U.S. PATENT DOCUMENTS

| | | | |
|---|---|---|---|
| 1,043,309 | 11/1912 | Fessmann et al. | 242/149 |
| 1,844,010 | 2/1932 | Hasbrouck | 242/150 R |
| 2,029,943 | 2/1936 | Reiners et al. | 242/150 R |
| 2,646,942 | 7/1953 | Heffelfinger | 242/149 |
| 2,646,944 | 7/1953 | Heffelfinger | 242/150 R |
| 2,881,988 | 4/1959 | Warwick | 242/150 R |
| 3,493,017 | 2/1970 | Govaert | 57/18 X |
| 3,701,244 | 10/1972 | Dismon et al. | 57/18 |
| 3,916,959 | 11/1975 | Konin et al. | 57/18 X |
| 4,157,722 | 6/1979 | Tojo et al. | 242/150 R X |
| 4,294,417 | 10/1981 | Camardella | 242/149 |

FOREIGN PATENT DOCUMENTS

| | | | |
|---|---|---|---|
| 186437 | 10/1922 | United Kingdom | 242/150 R |
| 668012 | 3/1952 | United Kingdom | 242/149 |
| 742895 | 1/1956 | United Kingdom | 242/150 R |
| 854848 | 11/1960 | United Kingdom | 242/149 |

*Primary Examiner*—Stanley N. Gilreath

*Attorney, Agent, or Firm*—Bell, Seltzer, Park & Gibson

[57] ABSTRACT

The present yarn tension control device is adaptable for regulating and adjusting the tension being applied to a running yarn being fed along a predetermined path of travel. The device includes first and second plate members having adjacent inner faces positioned on opposite sides of the running yarn with one of the plate members being resiliently urged toward the other plate member and in engagement with one side of the running yarn to thereby apply tension to the running yarn passing therebetween. The inner face of one of the plate members is substantially smooth and flat while the other plate member is provided with an opening extending through the central portion and the inner face is provided with shallow grooves extending radially outwardly from and being communicatively connected with the opening. The opening and the grooves in the plate member cooperate to provide passageways for the passage of air and for the escape of lint from between the plate members.

8 Claims, 6 Drawing Figures

YARN TENSION CONTROL DEVICE

FIELD OF THE INVENTION

This invention relates generally to a yarn tension control device and more particularly to such a device which includes first and second plate members having adjacent inner faces positioned on opposite sides and in engagement with opposite sides of a running yarn. One of the plates is resiliently urged toward the other plate and places a regulated amount of tension on the running yarn. The inner face of one of the plate members is substantially flat and smooth and the other of the plate members is provided with an opening extending through the central portion with the inner face being provided with shallow grooves extending radially outwardly from the central opening and to the outer edges of the plate to provide passageways for the passage of air and the escape of lint from between the first and second plate members.

BACKGROUND OF THE INVENTION

Many textile machines utilize a disk type of yarn tension device wherein the yarn runs between a pair of metal disks with one disk being resiliently urged against the yarn and toward the other disk by a compression spring. The amount of compressive force applied by the spring can be adjusted to vary the tension placed on the running yarn. This disk type of tension device has been in use for many years and operates satisfactorily in some applications but has a tendency to collect lint from the running yarn and the accumulated lint causes variations in tension of the yarn.

It is also generally known to position plate members on opposite sides of a running yarn to apply tension to the yarn passing therebetween. For example, this general type of tensioning device is illustrated in U.S. Pat. No. 1,564,995 wherein a yarn is tensioned by passing the same between a pair of corrugated plate members and one of the plate members is provided with a plurality of openings in each of the valleys of the corrugations so that the amount of tension placed on the yarn is varied by feeding the yarn upwardly through various ones of the opennings in the corrugations. U.S. Pat. No. 2,339,854 discloses a tension device which includes a corrugated back plate and a spring steel front plate with the yarn passing therebetween to apply tension thereto. The tension device of U.S. Pat. No. 2,451,889 includes a pair of wedge shaped plates supported in a guide so that the yarn may be passed between the plates at various positions and to thereby vary the length of travel of the yarn between the wedge shaped plates and to thereby change the tension applied thereto. In U.S. Pat. No. 2,643,831 the yarn passes between a pair of thin flexible plate members which may be bowed to various adjusted positions to vary the tension of the yarn passing therebetween.

A cable brake device is disclosed in U.S. Pat. No. 3,057,438 which includes a pair of opposed frictional rubber brake plates for engaging opposite sides of the cable and one of the brake plates is supported for inward and outward adjusted resilient engagement with the cable passing therebetween to vary the tension placed thereon. In the tension device of U.S. Pat. No. 3,144,997 the yarn runs over a glass plate and a plurality of friction pads are resiliently urged against the yarn to vary the pressure or resistance to movement of the yarn along the glass plate. U.S. Pat. No. 3,340,903 discloses a tensioning device which includes a wear resistant hard plate member over which the yarn passes and a flexible steel plate overlying the hard plate and being moved into resilient engagement with the yarn passing therebetween. The tension device of U.S. Pat. No. 3,633,711 includes a relatively thin steel strip overlying a foam backing and over which the yarn passes. A plurality of brake fingers is resiliently urged against the opposite side of the yarn and press the same into engagement with the steel sheet to apply tension to the yarn passing therebetween. U.S. Pat. No. 4,313,578 discloses one embodiment of a tension control device utilizing a pair of plate members having their adjacent inner faces positioned on opposite sides of the running yarn. One plate member is urged against the yarn and toward the other plate member by means of electromagnetic attraction to thereby apply tension to the yarn passing between the plate members.

The yarn tension devices of these prior patents also have generally the same problem associated with the well known disk type tension devices in that they tend to collect fiber particles and lint between the plate members and the accumulated lint can cause the tension applied to the yarn to be considerably varied. Also, many of the devices of these prior patents are difficult to clean and remove the lint therefrom. Further, it is difficult to thread the yarn through these prior art devices and to then properly regulate the tension being placed on the running yarn.

SUMMARY OF THE INVENTION

With the foregoing in mind, it is an object of the present invention to provide a tensioning device for accurately regulating and adjusting the tension placed on a running yarn and which is generally self cleaning so that a constant amount of tension is applied to the running yarn over a long operating period.

The yarn tension control device of the present invention includes first and second plate members having adjacent inner faces positioned on opposite sides of the running yarn with one of the plate members being resiliently urged toward the other plate member and against the yarn to thereby apply tension to the running yarn passing therebetween. The inner face of one of the plate members is substantially flat and smooth and the other of the plate members is provided with a central opening extending therethrough and the inner face is provided with shallow grooves extending radially outwardly from the central opening and to opposite sides of the plate member so that the opening and the grooves cooperate to provide passageways for the passage of air and for the escape of fiber particles and lint from between the first and second plate members.

One of the plate members is preferably supported in a fixed position and yarn guide means is positioned adjacent the entry and exit ends of the tensioning device for directing the running yarn over the inner face of the fixed plate member. The other plate member is preferably supported for swinging movement so that its inner face is positioned on the opposite side of the running yarn when in operation and may be swung to an open position for easy threading and cleaning of the plate members. When in the operating position, the movable plate member is resiliently urged against the yarn and toward the fixed plate member by resilient means in the form of a compression spring supported inside of the hollow shaft of a rotatable adjustment tension control wheel. The adjustment wheel is supported for inward and outward movement relative to the fixed plate and is rotatable to various tension settings to vary the amount of force applied against the movable plate by the compression spring housed in the hollow shaft of the adjustment wheel. Suitable indicia is provided on the adjustment wheel to indicate to the operator when a particular amount of tension is being applied to the running yarn and to provide quick and easy setting of the tension device in accordance with the type of yarn being tensioned thereby. It is preferred that the adjustment wheel be provided with indexing means to provide definite setting positions and to maintain the adjustment wheel in the rotational position set by the operator. The indexing means include a spring pressed detent carried by the adjustment wheel and elongated grooves radially spaced around the support shaft and engageable by the spring pressed detent to maintain the adjustment wheel in the adjusted position.

The movable plate member is preferably hingedly connected to the support member for the fixed plate member and is normally maintained in the closed or operating position by magnetic means, including a permanent magnet, so that the operator can swing the movable plate and the support member to an open position when it becomes necessary to clean lint or the like from between the plate members and/or when threading a yarn into position between the plate members. It is preferred that the plate member containing the central opening and the radial grooves be formed of a wear resistant ceramic material, such as aluminium oxide, and that the movable plate be formed of steel with a substantially flat and smooth inner face coated with wear resistant material, such as titanium, having an amotile or matte finish on the inner face thereof.

BRIEF DESCRIPTION OF THE DRAWINGS

Other objects and advantages will appear as the description proceeds in connection with the accompanying drawings, in which.

DESCRIPTION OF THE ILLUSTRATED EMBODIMENT

Figure 1:
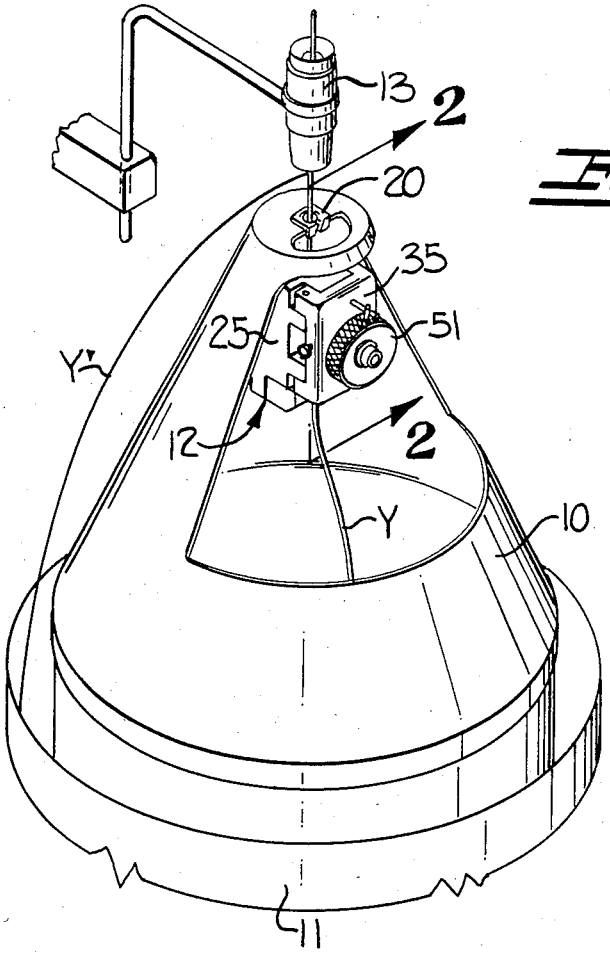
FIG. 1 is fragmentary perspective view of a small portion of a textile machine illustrating the yarn tension control device of the present invention associated therewith.

The yarn tension control device of the present invention is illustrated in FIG. 1 as being supported on a yarn balloon control hood 10 of a textile machine of the type known as a cable twister. A core yarn Y is shown being withdrawn from a supply package, not shown, supported in the balloon control cone or hood having a conical upper end 10. A second or wrap yarn Y′ is illustrated as being withdrawn from a second yarn supply package, not shown, and passing upwardly through a wind shield sleeve 11 to form a balloon around the hood 10. The yarn Y′ is wrapped or wound around the core yarn Y in a position above the hood 10 and then passes through a suitable tension control 13 supported above the hood 10. The tension control 13 may be of any suitable type and is illustrated as being a ball tension device of the type disclosed in my prior U.S. Pat. Nos. RE-30,920; RE-31,041; and RE-31,024. While the present yarn tension control device is illustrated in association with this particular type of cable twister, it is to be understood that the present yarn tension control device can be associated with and control the tension of running yarns in various other types of textile machines.

Figure 4:
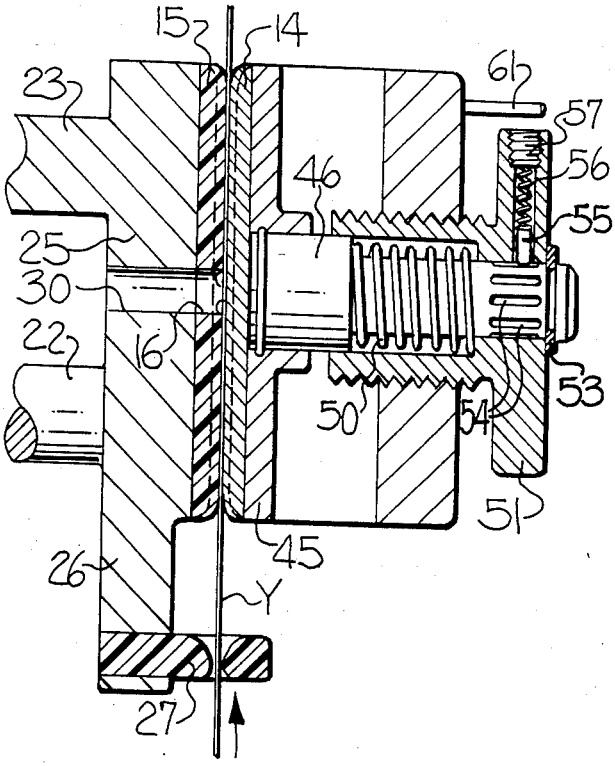
FIG. 4 is a longitudinal sectional view, at an enlarged scale, and being taken substantially along the line 4—4 in FIG. 3.
Figure 5:
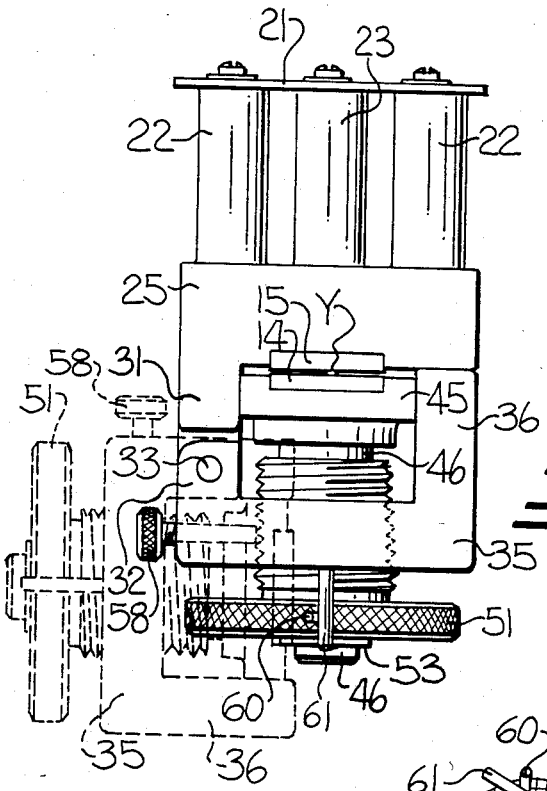
FIG. 5 is a plan view of the present yarn tension control device shown in the closed or operating position in solid lines and being shown in dotted lines in the open position.
Figure 6:
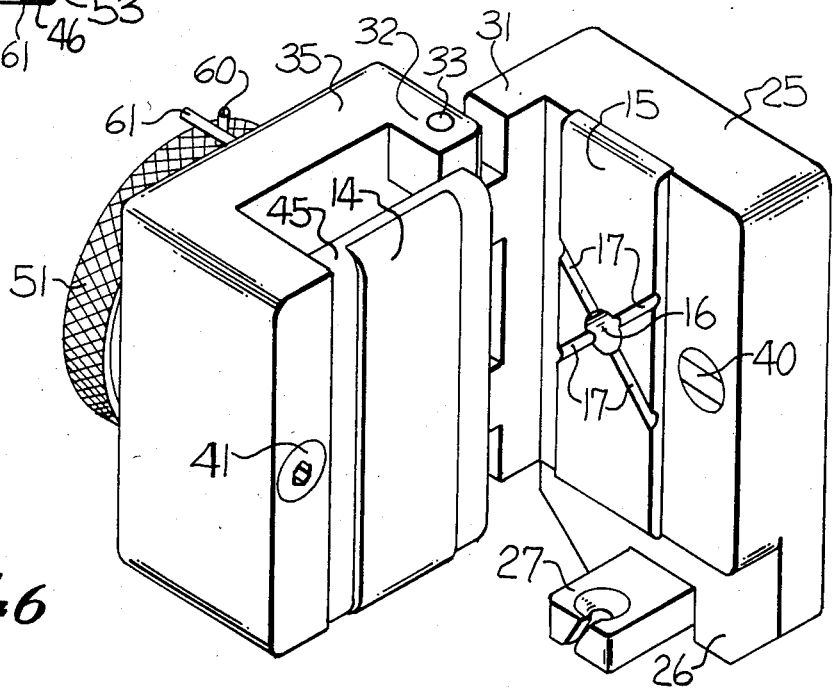
FIG. 6 is an elevational view of the fixed plate and illustrating the arrangement of the central opening and the radially extending shallow grooves formed therein.

The yarn tension control device of the present invention, broadly indicated at 12, regulates and accurately adjusts the tension placed on a running yarn Y being fed along a predetermined path of travel. The yarn tension control device 12 generally includes respective first and second elongate plate members 14, 15 having adjacent inner faces positioned on opposite sides of the running yarn Y (FIGS. 4–6). Means is provided for supporting the first and second plate members 14, 15 on opposite sides of the running yarn Y for relative movement toward and away from each other so as to be selectively moved into and out of engagement with the running yarn Y. Means is also provided for resiliently urging the first and second plate members 14, 15 toward each other to thereby apply tension to the running yarn Y passing therebetween.

As best shown in FIG. 6, the inner face of the first plate member 14 is substantially flat and smooth while the second plate member 15 is provided with an opening 16 extending through the central portion and the inner face is provided with shallow grooves 17 extending radially outwardly from and being communicatively connected with the central opening 16. The shallow grooves 17 extend outwardly to the outer edge portions of opposite sides of the second plate member 15. The opening 16 and the grooves 17 cooperate to provide passageways for the passage of air and for the escape of lint from between the first and second plate members 14, 15 so that the yarn tension control device 12 is essentially "self cleaning."

Figure 2:
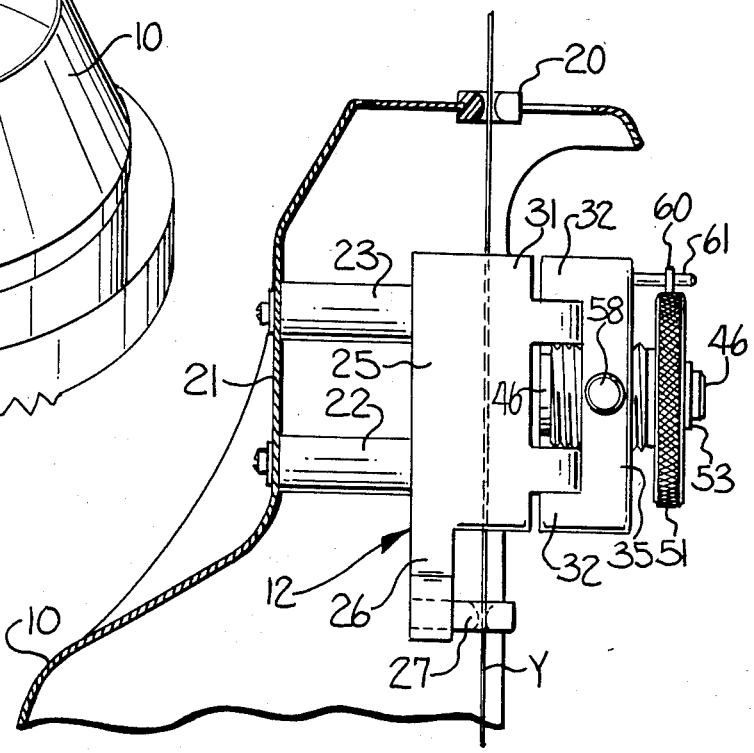
FIG. 2 is an enlarged fragmentary sectional view taken substantially along the line 2—2 in FIG. 1 and showing one side of the present yarn tension control device in elevation.

The yarn tensioning control device 12 shown in the drawings is maintained in a fixed position in the upper end of the yarn balloon control hood 10 and in vertical alignment below and upper yarn guide 20 affixed in the upper horizontal plate of the yarn balloon control hood 10 (FIGS. 1 and 2). The rear portion of the yarn balloon control hood 10 is provided with an inwardly indented and vertical wall section 21 (FIG. 2) on which the outer ends of a pair of lower support rods 22 and a single upper support rod 23 are fixed (FIGS. 2 and 5). The inner ends of the support rods 22, 23 are fixed to the outer surface of a base support block 25. The lower portion of the base support block 25 is provided with a downwardly depending leg 26 in which a yarn guide 27 is fixed. The lower yarn guide 27 and the upper yarn guide 20 engage the yarn Y and direct it upwardly between the first and second plate members 14, 15 and also maintain it substantially in the center as the yarn passes upwardly through the yarn tension control device 12.

The central inner portion of the base support block 25 is provided with a vertically extending slot or groove in which the second plate member 15 is fixedly secured, as by a suitable adhesive, and an opening 30 is provided in the base support block 25 (FIG. 4) and in alignment with the opening 16 in the second plate member 15. One side of the base support block 25 is provided with an integrally formed hinge plate 31. The hinge plate 31 is hingedly connected to integrally formed upper and lower hinge plates 32 by means of upper and lower hinge pins 33. The hinge plates 32 are integral with a movable support block 35 which is adapted to swing from the solid line closed or operative position to the dotted line open position shown in FIG. 5.

The opposite side of the movable support block 35 is provided with an inwardly extending and integrally formed stop leg 36. The base support block 25 and the movable support block 35 are preferably formed of non-magnetic material such as aluminum. In order to maintain the movable support block 35 in a closed position, as shown in FIG. 5, a permanent magnet 40 is embedded in one side of the base support block 25 and a screw 41 is threaded into the stop leg 36 of the movable support block 35 and in alignment with the permanent magnet 40 so that the movable support block 35 will remain in a closed or operative position during operation of the yarn tension control device 12. The magnetic closure also permits easy opening or swinging of the movable support block 35 from the closed operating position to the open position, as shown in FIG. 6, for cleaning and threading of the yarn.

The first plate member 14 is preferably formed of steel and has an substantially flat and smooth inner face with a coating of wear resistant metal, such as titanium, with an amotile or matte finish thereon. The first plate member 14 is supported in the movable support block 35 for resilient engagement with the yarn passing between the first plate member 14 and the second plate member 15. To this end, the first plate member 14 is fixed, as by a suitable adhesive in a vertical groove in a "floating" support plate 45 suitably supported for resilient inward and outward movement relative to the second plate member 15. The support plate 45 is fixed on the enlarged inner end of a control shaft 46 supported for longitudinal inward and outward movement toward and away from the second plate member 15.

As will be noted in FIG. 4, the outer portion of the control shaft 46 is reduced in diameter and a compression spring 50 surrounds the reduced portion of the control shaft 46. The inner end of the compression spring 50 bears against the shoulder formed on the control shaft 46 and the outer end bears against and is seated in the outer end of a bore provided in the threaded inner end of a shaft portion of a tension control adjustment wheel 51. The threaded shaft portion of the control wheel 51 is threadably supported in a threaded bore in the central portion of the movable support block 35 so that the control adjustment wheel 51 moves inwardly and outwardly with rotation thereof.

Figure 3:
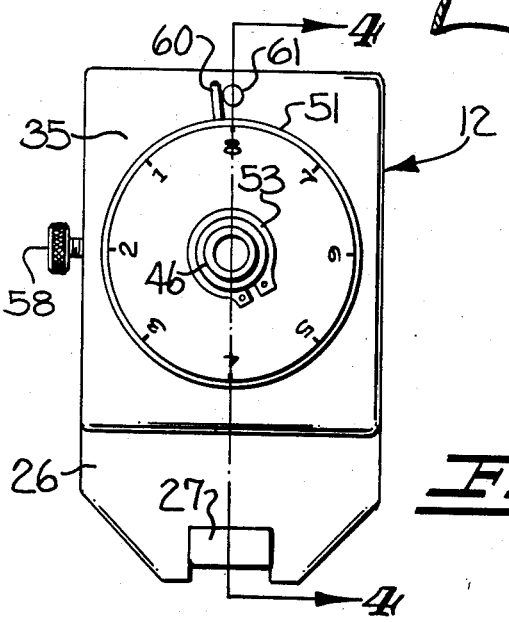
FIG. 3 is an enlarged front elevational view of the present yarn tension control device.

The compression spring 50 urges the control shaft 46 inwardly against a lock ring 53 supported in a groove in the outer end portion of the control shaft 46. The outer surface of the adjustment wheel 51 is preferably provided with indicia, as indicated in FIG. 3 at 1–8, indicating the amount of tension being applied to the yarn Y passing between the first and second plate members 14, 15. In order to provide indexing movement of the adjustment wheel 51, the outer portion of the control shaft 6 is provided with radially spaced and longitudinally extending slots 54 (FIG. 4) and a detent 55 is supported for longitudinal movement in a bore in the control wheel 51.

A compression spring 56 urges the detent 55 into engagement with the slots 54 when the control wheel 51 is rotated. A screw 57 is provided in the outer portion of the bore in the control wheel 51 to engage the outer end of the compression spring 56 for maintaining the inner end of the detent 55 in resilient engagement with the outer end of the control shaft 46 and the indexing slots 54.

It is preferred that a set screw 58 (FIGS. 2 and 5) be threadably supported in the movable support block 35 with its inner end being movable into locking engagement with the threaded shaft portion of the tension control wheel 51. The set screw 58 is rotated to move the inner end out of locking engagement with the threaded shaft portion of the tension control wheel 51 so that the tension control wheel 51 can be rotated to the proper position. After the tension control wheel 51 is rotated to the proper adjusted position, the set screw 58 is rotated to move the inner end into locking engagement with the threaded shaft portion of the tension control wheel 51 to lock the same in the adjusted position. The set screw 58 prevents accidental rotation of the tension control wheel 51 such as may occur when the movable support block is moved to the open position. The set screw 58 also prevents rotation of the tension control wheel 51 by machine vibration or the like.

A stop pin 60 extends outwardly in a radial direction on the outer surface of the adjustment wheel 51 and is adapted to engage a stop pin 61, as shown in FIG. 3, to limit rotation of the control wheel 61 to substantially one complete revolution. When the yarn tension control device 12 is in the closed or operative position, as shown in FIG. 4, the rotational position of the adjustment wheel 51 determines the amount of compressive force applied by the compression spring 50 to the support plate 45. This inwardly resilient pressure is applied against the yarn Y passing between the first and second plate members 14, 15.

When using the yarn tensioning control device 12 for regulating and adjusting the tension placed on the running core yarn Y in a cable twister, as illustrated in the drawings, it has been found that the plate members 14, 15 apply the proper amount of tension when they are 19 mm wide and 60 mm long. The opening 16 in the second plate member 15 is 6 mm in diameter while the radially extending grooves 17 are 2.5 mm in diameter. When in operating position, the yarn Y passes upwardly between the first and second plate members 14, 15, and across the center of the opening 16 and the adjustment wheel 51 is rotated to apply the desired amount of inward resilient pressure on the first plate 14 against one face of the yarn 15. As the yarn Y passes upwardly between the plates 14, 15, it is somewhat smoothed by the plates 14, 15 resiliently engaging opposite sides thereof. The opening 16 and the grooves 17 cooperate to permit any lint to escape and to be removed from between the plates 14, 15. The opening 16 and the grooves 17 also provide a passageway for air between the plates 14, 15 while the yarn is being tensioned by the present yarn tensioning control device 12.

The movable support block 35 is held in the closed operative position against the base support block 25 by means of the permanent magnet 40 and the metal screw 41. The plate members 14, 15 can be easily separated by the operator swinging the movable support block 35 outwardly to the position shown in FIG. 6 so that any accumulated lint can be easily cleaned from the first and second plates 14, 15. In this position, the yarn Y can be easily threaded across the face of the plate 15 before returning the movable support block 35 to the closed or operative position.

Thus, the amount of tension applied to the running yarn Y is controlled by rotation of the adjustment wheel 51 to thereby change the amount of compressive force applied to the first plate member 14 against the yarn Y and the second plate member 15. The amount of force applied by the compression spring 50 bearing against the shoulder of the control shaft 46 is varied by the rotational position of the adjustment wheel 51.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A yarn tension control device for regulating and adjustably varying the tension placed on a running yarn being fed along a predetermined path of travel, said device including first and second plate members having adjacent inner faces positioned on opposite sides of the predetermined path of travel of the running yarn, means supporting said first and second plate members for relative movement toward and away from each other for selective movement of the inner faces of said plate members into and out of engagement with the running yarn, means for resiliently urging said plates toward each other to thereby apply tension to the running yarn passing therebetween, the inner face of said first plate member being substantially flat and smooth and including parallel opposite side edges, and said second plate member including parallel opposite side edges aligned with said opposite side edges of said first plate member, and having an opening extending through the central portion thereof, said inner face of said second plate member having shallow grooves therein, said shallow grooves including inner and outer ends and extending radially outwardly from said opening, said inner ends of said shallow grooves being communicatively connected with said opening, and said outer ends of said shallow grooves being communicatively connected with said opposite side edges of said second plate member, said opening and said grooves cooperating to provide passageways for the passage of air and for the escape of lint from between said first and second plate members.

2. A yarn tension control device according to claim 1 wherein said means supporting said first and second plate members includes a base support block mounting said second plate member in a fixed position on one side of the path of travel of the running yarn, means carried by said base support block mounting said first plate member on the other side of the path of travel of the running yarn for movement toward and away from said second plate member, and wherein said resilient means urges said first plate member inwardly toward said second plate member and against the running yarn.

3. A yarn tension control device according to claim 2 wherein said means mounting said first plate member includes a control shaft mounted for longitudinally movement toward and away from said second plate member and supporting said first plate member on the inner end thereof, and wherein said resilient means includes a compression spring surrounding said control shaft and normally urging said control shaft and first plate member inwardly and a rotatable adjustment wheel surrounding said control shaft and movable longitudinally thereof and engaging one end of said compression spring for varying the amount of compressive force applied by said compression spring to said control shaft and said first plate member.

4. A yarn tension control device according to claim 3 including a movable support block hingedly mounted on said base support block and supporting said control shaft, first plate member, adjustment wheel and compression spring thereon, and wherein said adjustment wheel includes an inwardly extending stem portion threadably supported in said movable support block for inward and outward movement upon rotation of said adjustment wheel.

5. A yarn tensioning control device according to claim 4 including indexing means for resiliently maintaining said adjustment wheel in adjusted position, said indexing means including radially spaced longitudinally extending grooves in the outer end of said control shaft, a spring pressed detent carried by and extending radially inwardly of said adjustment wheel, and said spring pressed detent having an inner end resiliently urged into engagement with said control shaft and said radially spaced grooves therein.

6. A yarn tensioning control device according to claim 1 wherein said first plate member is formed of steel, and wherein said second plate member is formed of ceramic material.

7. A yarn tensioning control device according to claim 6 wherein the inner face of said first plate member is coated with wear resistant titanium metal.

8. A cable twister textile machine for wrapping a yarn around a core yarn and including a balloon control hood having a conical upper end, a yarn guide in the upper conical end of said balloon control hood for directing the core yarn upwardly therethrough, a yarn tension control device supported in the upper portion of said balloon control hood and adjacent said yarn guide in the upper conical end thereof, said yarn tension control device including a lower yarn guide for directing the core yarn upwardly through said yarn tension control device and said yarn guide in the upper conical end of said balloon control hood, said yarn tension control device including first and second plate members having adjacent inner faces positioned on opposite sides of the predetermined path of travel of the running yarn, means supporting said first and second plate members for relative movement toward and away from each other for selective movement of the inner faces of said plate members into and out of engagement with the running yarn, means for resiliently urging said plates toward each other to thereby apply tension to the running yarn passing therebetween, the inner face of said first plate member being substantially flat and smooth, and said second plate member having an opening extending through the central portion thereof and said inner face of said second plate member having shallow grooves therein extending radially outwardly from and communicatively connected with said opening, said opening and said grooves cooperating to provide passageways for the passage of air and for the escape of lint from between said first and second plate members.

* * * * *